US006443687B1

(12) United States Patent
Kaiser

(10) Patent No.: US 6,443,687 B1
(45) Date of Patent: Sep. 3, 2002

(54) EXCAVATOR-HOIST

(75) Inventor: Dietmar Kaiser, Schaanwald (LI)

(73) Assignee: Kaiser Aktiengesellschaft, Schaanwald (LI)

( * ) Notice: Subject to any disclaimer, the term of this patent is extended or adjusted under 35 U.S.C. 154(b) by 0 days.

(21) Appl. No.: 09/543,807

(22) Filed: Apr. 6, 2000

Related U.S. Application Data

(63) Continuation-in-part of application No. 09/082,863, filed on May 21, 1998, now abandoned.

(30) Foreign Application Priority Data

May 23, 1997 (AT) ..... 897/97

(51) Int. Cl.[7] ..... E02F 3/00

(52) U.S. Cl. ..... 414/685; 280/6.156; 280/43; 180/209

(58) Field of Search ..... 414/685, 687, 414/680, 694; 212/302, 305; 180/209, 41, 242, 906; 280/6.153, 6.154, 6.155, 6.156, 43, 43.17, 86.5

(56) References Cited

U.S. PATENT DOCUMENTS 3,279,622 A * 10/1966 Person ..... 212/305
4,360,311 A * 11/1982 Dufour ..... 414/687
4,392,541 A * 7/1983 Barchard ..... 180/209
4,705,133 A * 11/1987 Christenson ..... 180/209
5,498,021 A * 3/1996 Christenson ..... 180/209
5,755,382 A * 5/1998 Skotinkov ..... 286/61.55 X

* cited by examiner

*Primary Examiner*—Donald W. Underwood
(74) *Attorney, Agent, or Firm*—Sidley Austin Brown & Wood, LLP

(57) ABSTRACT

An excavator-hoist including a chassis for supporting an operator's cab, a drive assembly, and a boom with a working tool supported at the free end of the boom, two pairs of projecting pivotable arms connected to opposite end sides of the chassis, respectively, for supporting at their free ends two pairs of wheels, with the arms, which support the front wheels having free end portions offset relative to respective remaining portions of the front wheel supporting arms in a vertical plane, with the front wheels being carried by the offset portions of the arms, and with respective piston-cylinder units, which are provided for pivoting the front wheel supporting arms in respective vertical planes, having one of their respective ends attached to the respective arms above pivot axes of the respective arms, and having another of their respective ends attached in respective regions of bottoms of the respective arms.

3 Claims, 3 Drawing Sheets

EXCAVATOR-HOIST

RELATED APPLICATIONS

This application is a continuation-in-part of application Ser. No. 09/082,863 filed May 21, 1998, abandoned.

BACKGROUND OF THE INVENTION

1. Field of the Invention

The present invention relates to an excavator-hoist including a chassis for supporting an operator's cab, a drive assembly and a boom carrying at its free end a working tool, with the excavator-hoist further including two pairs of projecting arms connected to opposite end sides of the chassis, respectively, hydraulically operated piston-cylinder means for pivoting the arms in horizontal and vertical planes, and two pairs of motor-driven wheels supported on free ends of arms of respective pairs of arms, with the wheels of both pairs having approximately the same diameter, and the wheels of at least one pair being steerable.

2. Description of the Prior Art

A construction similar to that described above is in German Publication DE 42 19 803AI. It discloses a working tool assembled from a set of prefabricated separate units. The working tool is driven by a stepping or gear drive assembly. The undercarriage includes two connection devices for connecting two, sliding one beneath the other, pairs of hinge supports which are pre-assembled from a set of interchangeable, vertically and horizontally pivotable, wheeled or steady supports, so that the undercarriage is alternatively supported by two wheeled supports and two steady supports or by four wheeled supports. At that, at least two wheels of the pair of wheeled supports are driven and steered with wheel hub motors, with the remaining wheels being provided with parallel guiding means. Further units, which are connected with each other, form a superstructure, which is connected with a support housing by a pivot support, and a boom section secured on a pivot bracket. The object of the German reference is to provide means which would insure an assembly on a work cite of a working aggregate from a set of separate functional constructional units with relatively small expenses. The constructional unit themselves should have a construction which would insure, dependent on the use condition, formation, amplification or retooling of different excavators or movable cranes. E.g., the set described in the German reference permits to convert a simple walking excavator into a wheeled excavator to adapt it to improved driving conditions.

An object of the present invention is an excavator-hoist with an improved mobility.

Another object of the present invention is to provide an excavator-hoist having a compact construction and which can easily be moved.

A further object of the present invention is an excavator-hoist with simple maintenance requirements so that it can be used for digging trenches and, in particular, water-carrying trenches.

SUMMARY OF THE INVENTION

These and other objects of the present invention, which will become apparent hereinafter, are achieved by providing an excavator-hoist of the type described above in which the arms, which support the steerable wheels, have front upwardly offset portions in a vertical plane, with the steerable wheels being carried by offset portions of the steerable wheel supporting arms, and with respective piston-cylinder units, which are provided for pivoting the steerable wheel supporting arms in respective vertical planes, having one of their respective ends attached to the respective arms above pivot axes of the respective arms, and having another of their respective ends attached in respective regions of bottoms of the respective arms. According to a particularly preferred embodiment of the present invention, the steerable wheel supporting arms have a box-shaped or downwardly-opening U-shaped profile, with each of the arms having a recess formed in a vertical longitudinal central plane of the arm for accommodating the arm-pivoting piston-cylinder unit. This measure permits to lift the bent-off arm rather high, with a sufficiently large free space still being available for a sidewise movement of the boom. At that, the piston-cylinder unit is adequately protected.

According to a further development of the present invention, there is provided a pair of L-shaped pivot levers for supporting the steerable wheel, with a horizontal leg of each pivot lever carrying an upright bolt an axis of which is located in a radial central plane of a respective steerable wheel, the bolt being rotatably received in a bearing bore provided in a free end of a respective steerable wheel supporting arm and located approximately in a vertical longitudinal central plane of the respective steerable wheel supporting arms. When the excavator-hoist moves along a muddy and wet bottom, the steerable wheel, together with the vertically offset portions of the arm, form only a small surface which displaces along the muddy and wet bottom. On the other hand, when the wheels are positioned in a manner known from the state of the art, the wheel, together with their carriers located sidewise with respect to the supporting arms, present increased resistance surfaces which act as plowshares against the muddy mass when the excavator-hoist need to be moved.

BRIEF DESCRIPTION OF THE DRAWINGS

The features and objects of the present invention will become more apparent and the invention itself will be best understood from the following detailed description of the preferred embodiments when read with reference to the accompanying drawings, wherein.

DETAILED DESCRIPTION OF THE PREFERRED EMBODIMENT

Figure 1:
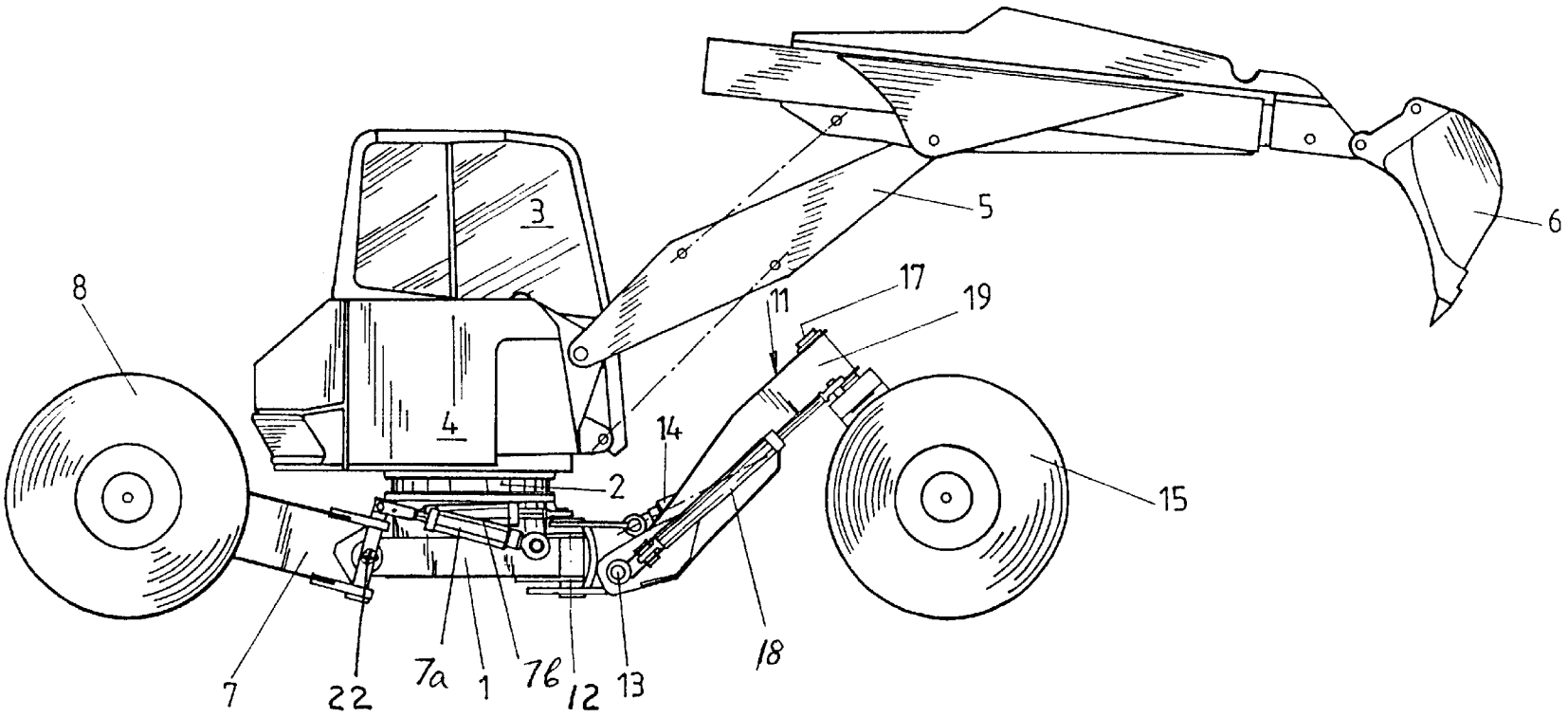
FIG. 1 shows a side view of an excavator-hoist according to the present invention.
Figure 2:
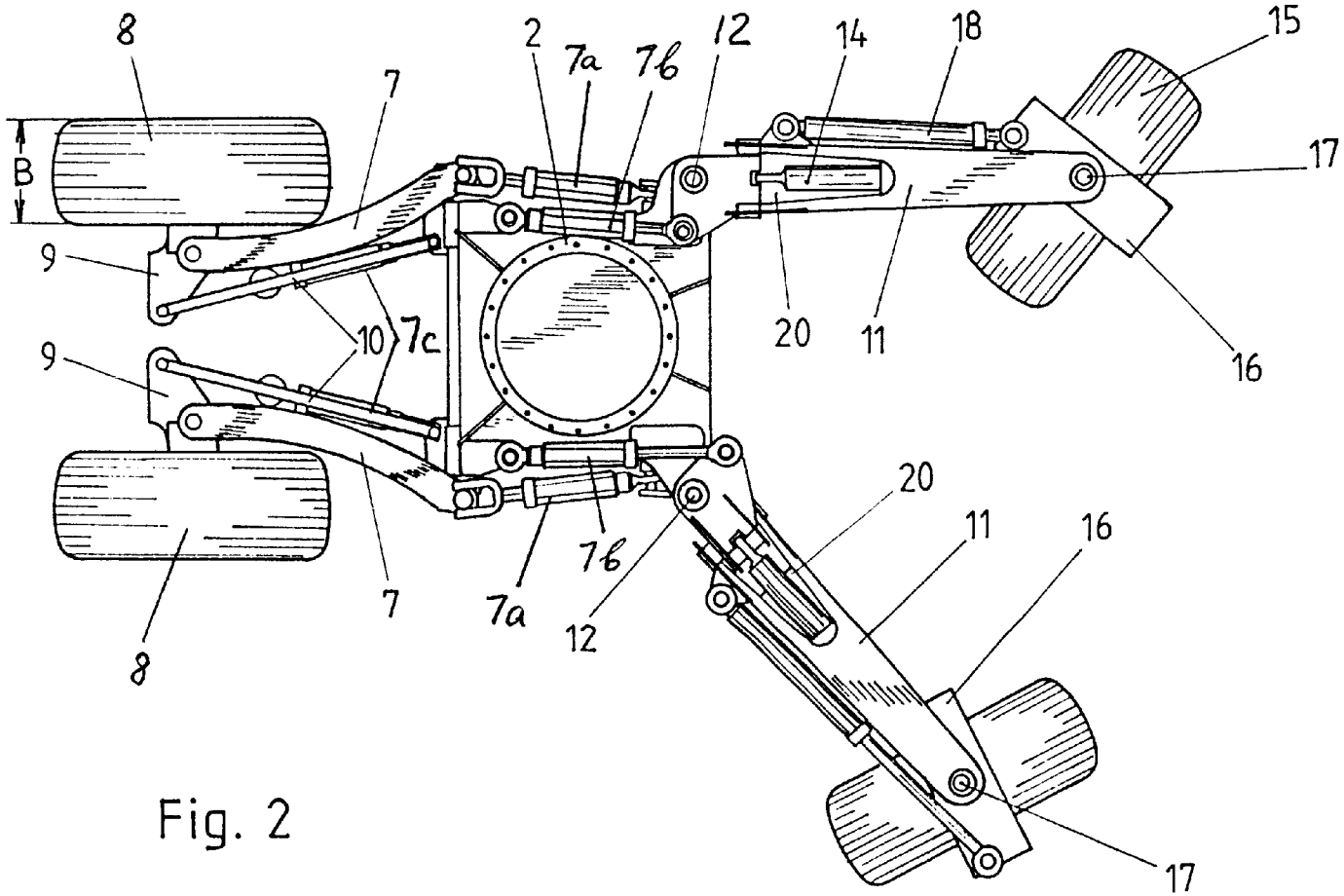
FIG. 2 shows a top view of an excavator-hoist according to the present invention, with the structure above the slewing ring removed for the sake of clarity.
Figure 3:
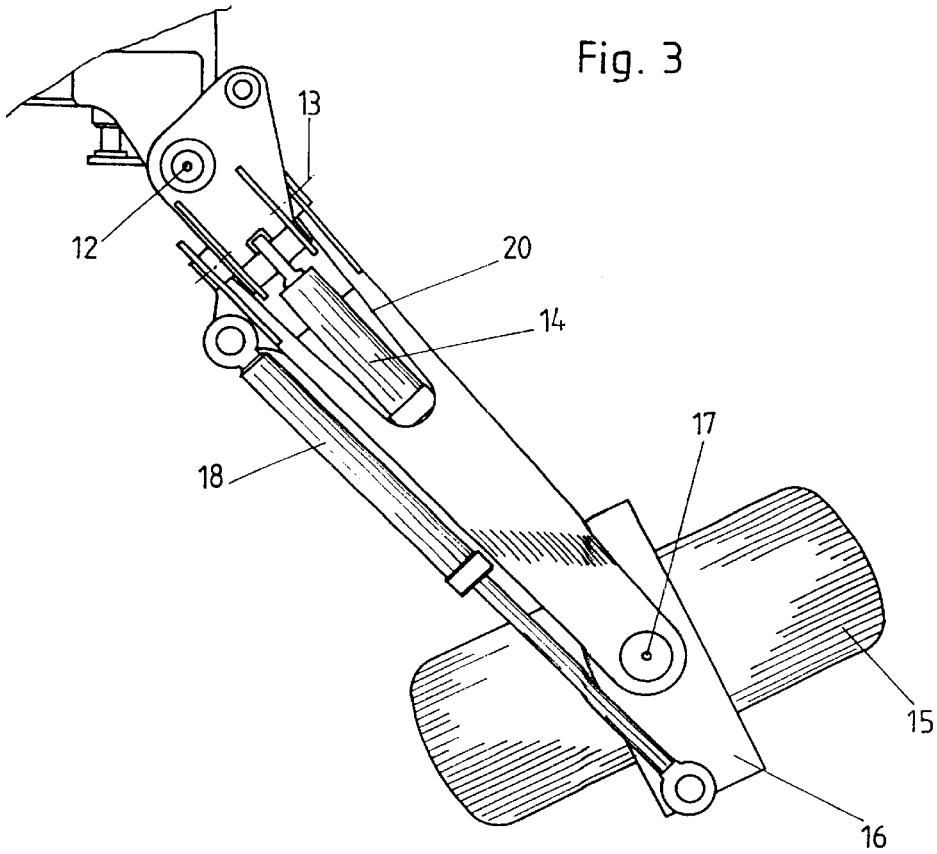
FIG. 3 shows a top view of an excavator arm with a steerable wheel of the excavator-hoist shown in FIG. 1, at an increased scale.
Figure 4:
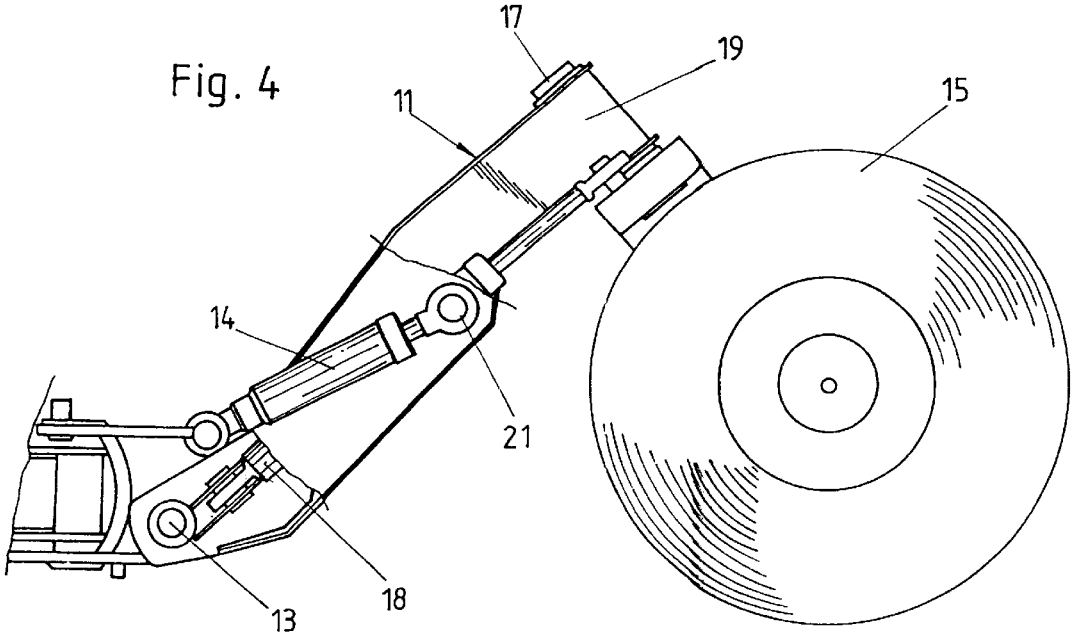
FIG. 4 shows a side view of an excavator arm with a steerable wheel of the excavator-hoist shown in FIG. 1, at an increased scale.

An excavator-hoist according to the present invention, which is shown in the drawings, includes a substantially rectangular chassis 1, a slewing ring 2 located above the chassis, and an operator's cab 3 supported on the slewing ring 2. The inventive excavator-hoist further includes a drive assembly 4 and a multi-sectional boom 5 with a shovel 6 which serves as a working tool. A pair of arms 7, which pivot in both horizontal and vertical planes are connected to the rear end side of the chassis 1. The pivotal movement of the arms 7 in the vertical plane about respective axes 22 is effected with hydraulically operated piston-cylinder units having one of their ends supported on the chassis 1. The arms 7 carry, at their free ends, respective wheels 8 supported on respective pivot levers 9. The pivotal movement of the arms 7 and the wheels 8 in the horizontal plane is effected with piston-cylinder units 7*c*. The pivot levers 9, together with connecting rods 10 and arms 7 form two parallelograms which serve to insure a parallel movement of the wheels 8 during a horizontal pivotal movements of the arms 7. The wheels 8 are located sidewise of the respective arms 7, and drive motors are arranged in the hubs of the respective wheels 8. The wheels 8 have a diameter of 100 cm and more. The arms 7 are slightly bent outwardly, as can be seen in FIG. 2. This permits to keep the overall width of the excavator-hoist according to the present invention small despite large width B of the wheels 8.

Another pair of arms 11 is attached to the front end of the chassis 1. The arms 11 are supported for pivotal movement about vertical axes 12 and horizontal axes 13. The arms 11 are pivoted about their vertical axes 12 by respective piston-cylinder units 7b. For effecting the pivotal movements of the arms 11 about their respective horizontal axes 13, there are provided respective, likewise hydraulically operated, piston-cylinder units 14 of which only one piston-cylinder unit 14 is clearly shown and which serves for pivoting a respective arm 11 about a respective horizontal axis 3. Wheels 15 are provided at the free ends of the respective arms 11. The diameter of the wheels 15 correspond to that of the rear wheel 8. The wheels 15 are supported with L-shaped pivot levers 16, the upper horizontal legs of which carry respective upright bolts 17 the axes of which lie in radial central planes of the respective wheels 15. The bolts 17 are rotatably received in bearing bores provided at the free ends of respective arms 11. The bolt axes intersect the axes of the respective wheels 15. The bolts 17 are arranged approximately in the vertical longitudinal central planes of the respective arms 11. The respective pivot levers 16 are connected with respective piston-cylinder units 18 arranged sidewise of respective arms 11. The opposite ends of the piston-cylinder units 18 are connected fixedly to the respective arms 11. The piston-cylinder units 18 of the two arms 11, which pivot respective wheels 15, are so connected with each other hydraulically that upon actuation of the piston-cylinder units 18, both wheels 15 pivot in the same direction about their respective axes defined by the bolts 17.

The two arms 11 have their front portions 19 offset upwardly in a vertical plane, with the upwardly offset portions 19 carrying respective pivot levers 16. Each arm 11, which has a box-shaped or downward-opening U-shaped profile, has at its side adjacent to the chassis 1, an upper recess 20. The piston-cylinder unit 14 has one of its end secured to the arm 11 above the horizontal pivotal axis 13. The piston-cylinder unit 14 is located in the recess 20 inside the arm 11, with the other end 21 of the piston-cylinder unit 14 being located in the recess 20. Hydraulic drive motors are provided in the hubs of the wheels 15.

The hydraulic motors of one side of the excavator-hoist and the hydraulic motors of the other side of the excavator-hoist, with reference to their vertical longitudinal central planes, are serieusly connected. The hydraulic circuit for driving the wheels 8 and 15 can also include a four-way oil distributor, with the drive motors of the wheels 8 and 15 being connected to the distributor. The arms 7 and 11 have substantially the same axial lengths.

The four-wheel steerable excavator-hoist according to the present invention is extremely mobile and, therefore, can handle all four sides. Despite its large wheels and protruding arms, the excavator hoist according to the present invention has a very stable construction which is insured by providing the upward-bent arms 11, the steerable wheels 8 and 15, and by shielded arrangement of the piston-cylinder units 14. The excavator-hoist according to the present inventions is particularly suitable for digging trenches due to its easy maintenance and servicing.

Though the present invention was shown and described with references to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. An excavator-hoist, comprising:

a chassis;

an operator's cab and a drive assembly supported on the chassis;

a boom secured at one end thereof to a front end side of the drive assembly and having an opposite free end;

a working tool supported at the free end of the boom;

a first pair of projecting arms connected to the front end side of the chassis and having each a free end portion offset in a vertical plane, upwardly relative to a remaining portion of a respective arm;

a second pair of projecting arms connected to an opposite, rear end side of the chassis;

first hydraulically operated piston-cylinder units for pivoting the arms of the first pair of arms in horizontal and vertical planes, with the piston-cylinder units, which pivots the arms in respective vertical planes, having one of their respective ends attached to the respective arms above pivot axes of the respective arms, and having another of their respective ends attached in respective regions of bottoms of the respective arms;

second hydraulically-operated piston-cylinder units having first ends thereof secured to the chassis and having second ends thereof secured to respective arms of the second pair of arms for pivoting the arms in horizontal and vertical planes;

a pair of front wheels supported on and carried by the upwardly offset free end portions of the arms of the first pair of arms; and a pair of rear wheels supported on free end portions of the arms of the second pair of arms and having a diameter approximately equal to a diameter of the front wheels.

2. An excavator-hoist as set forth in claim 1, wherein the arms of the first pair of arms have one of a box-shaped and downward-facing U-shaped profile, and wherein each of the arms of the first pair of arms has a recess formed in a longitudinal central vertical plane in an upper surface thereof for accommodating a respective piston-cylinder unit of the first piston-cylinder units.

3. An excavator-hoist as set forth in claim 1, further comprising a pair of L-shaped pivot levers for supporting the two front wheels, respectively, with a horizontal leg of each pivot lever carrying an upright bolt an axis of which is located in a radial central plane of a respective front wheel, the bolt being rotably received in a bearing bore provided in a free end of a respective front wheel supporting arm and located approximately in a vertical longitudinal central plane of the respective front wheel supporting arms.

* * * * *